United States Patent [19]

Lankard et al.

[11] 4,148,660

[45] Apr. 10, 1979

[54] PLASTER MOLDING COMPOSITION

[75] Inventors: David R. Lankard, Columbus, Ohio; Walter A. Hedden, Sanibel, Fla.

[73] Assignee: PMCMA Research Group, Dayton, Ohio

[21] Appl. No.: 862,143

[22] Filed: Dec. 19, 1977

Related U.S. Application Data

[63] Continuation-in-part of Ser. No. 660,444, Feb. 23, 1976, Pat. No. 4,081,283.

[51] Int. Cl.[2] ..... B28B 7/34

[52] U.S. Cl. ..... 106/38.3; 106/109; 106/110; 106/DIG. 1; 106/DIG. 2; 106/38.9

[58] Field of Search ..... 106/38.3, 109, 110, 106/DIG. 2, DIG. 1

[56] References Cited

U.S. PATENT DOCUMENTS

| | | | |
|---|---|---|---|
| 2,980,548 | 4/1961 | Hampton | 106/111 |
| 3,311,516 | 3/1967 | Jaunarajs | 106/110 |
| 3,819,388 | 6/1974 | Cornwell | 106/DIG. 2 |

*Primary Examiner*—James Poer

*Attorney, Agent, or Firm*—Biebel, French & Nauman

[57] ABSTRACT

A fiber-free plaster molding composition which comprises by weight approximately 50–70% gypsum plaster, 5–25% fine expanded perlite, and 5–30% of a non-fibrous filler such as mica, silica, fly ash, pyrophyllite or mixtures thereof. The composition of this invention has good dry blending properties, slurry characteristics, and wet and dry mold features, making it a suitable replacement for fiber-containing molding compositions for low fusion metal casting molds.

6 Claims, No Drawings

PLASTER MOLDING COMPOSITION

CROSS-REFERENCE TO RELATED APPLICATIONS

This is a continuation-in-part of U.S. application Ser. No. 660,444, filed Feb. 23, 1976, now U.S. Pat. No. 4,081,283, issued Mar. 28, 1978.

BACKGROUND OF THE INVENTION

This invention relates to fiber-free plaster molding compositions and, more particularly, to a suitable molding composition to replace the fiber-containing compositions commonly used in preparing metal casting molds.

Low temperature fusion metals, such as aluminum, have for generations been cast in disposable plaster molds made primarily from calcined gypsum plaster (i.e., plaster of paris) and a mineral fiber such as fibrous talc (an asbestos-like material). While even as early as around 1900, there were suggested improvements (see for example, U.S. Pat. Nos. 816,833 and 821,718), the commercial mix has remained essentially unchanged to the present day.

Typically, these fine castings molding compositions comprise around 50% gypsum plaster, 30% fibrous talc, 19% sand, 1% Portland cement and a small amount of an accelerator such as Terra Alba. Such a plaster mold composition is ideally suited to an end use of this particular type.

That end use involves (1) dry blending of the components into a molding composition, (2) slurrying the dry blend with water, (3) pouring the slurry around a master pattern, (4) stripping the hardened wet mold from the master, (5) trimming and patching as necessary, (6) drying in an oven, (7) gating and inserting chills, (8) pouring the molten metal such as aluminum in the mold, (9) cooling, (10) separating the cast metal shape from the mold by using a high-pressure water blast-off, and (11) disposing of or recycling the used mold. Slurrying is commonly done in a Hogue machine (a screw-type blender).

The fibrous-talc containing molding composition meets the various requirements needed of the material at each step. It is easily dry blended. The materials are relatively inexpensive. Slurry characteristics are good, making mixing in a Hogue machine possible. Setting times are fast. The wet and dry mold features are acceptable in terms of density, strength, permeability, shrinkage, and penetration resistance. In addition, the mold surfaces produced with such compositions are of generally good quality.

Despite all of this, gypsum-fibrous talc-sand molding compositions can no longer be used in making metal casting molds. The reason is that the fibrous talc has been removed from commerce because it is allegedly objectionable as a health hazard under recently enacted OSHA regulations. The need thus exists for a suitable fibrous talc-free replacement for such molding compositions.

One possibility is use of a composition marketed by Georgia Pacific Corp. of Portland, Oregon. It utilizes approximately 74% gypsum plaster, 12% wollastonite, 9% diatomaceous earth, 3% sand, and 2% calcium aluminate cement. The problem with this type of composition is that during slurrying in the Hogue machine, it does not achieve the consistency required quickly enough. Thus, the slurry poured onto the master is too thin so that material segregation occurs due to settling with resultant adverse affects on the quality of the plaster mold itself and metals cast into it. Of course, as the plaster hydrates and sets up, the slurry thickness is increased to the point where a proper consistency is achieved, but by this time it has lost its usefulness relative to its use in the continuous commercial mixing machines.

Another possibility is the plaster molding composition of the parent application, Ser. No. 660,444, which comprises by weight approximately 50–70% gypsum plaster, 5–20% fibrous wollastonite, 5–25% fine expanded perlite and 0–40% of a filler selected from the group consisting of sand, fly ash, pyrophyllite and mixtures thereof. That composition meets all the requirements dry blending and slurrying, and has excellent wet and dry mold features. Still, it contains a fibrous material—wollastonite—which is in short supply and may itself eventually become objectionable under OSHA regulations.

Accordingly, there remains a need to develop a totally fiber-free molding composition having characteristics at least as good as those of the fibrous talc-containing molding compositions.

SUMMARY OF THE INVENTION

The present invention meets that need by providing a fiber-free molding composition for use in making metal casting molds. By "fiber" it is meant, mineral fibers such as asbestos and fibrous talc. The composition of this invention does not use such asbestos-type fibers or any other mineral fibers, but rather composes by weight approximately 50–70% gypsum plaster, 5–25% fine expanded perlite, 5–30% non-fibrous filler, and, optionally, a minor amount (e.g., approximately 1%) of accelerator.

The gypsum plaster is a calcined gypsum (plaster of paris) such as that known as No. 1 Molding Plaster from U.S. Gypsum Co., Chicago, Illinois. The expanded perlite used is a fine expanded silicous volcanic rock material, at least 50% of which will pass through a −50 mesh screen. This would include Grades No. 4, 3S, or 39 Ryolex perlite from the Silbrico Corp. of Hodgkins, Illinois. Fillers for use in the present invention may be selected from the group consisting of mica, silica, fly ash, pyrophyllite and mixtures thereof. A preferred material is a mixture of mica and another non-fibrous filler such as fly ash. The preferred mica is a fine material which passes at least a 60 mesh sieve. Such a material can be obtained from Harris Mining Co., Spruce Pine, N.C. Fly ash is the residue resulting from the combustion of ground or pulverized coal and is carried from the boiler by flue gasses. It is available from any number of sources who collect it upon separation from the flue gases. Other thermally stable ceramic materials could also be used. Examples are alumina, calcined clays, bauxite, and olivine. The accelerator may be Terra Alba or any other known accelerator for gypsum plaster.

As can be seen, the replacement of the fiber of prior molding compositions comes primarily from the use of fine expanded perlite. The expanded perlite provides body to the high water content slurries and its use enables the molding composition to perform properly in preparing suitable metal castings molds. To illustrate, a catalog of some of the desirable qualities of the molding composition of the present invention follows:

A. Dry Blend Properties (1) The ingredients are all readily available from existing sources.

(2) All ingredients are non-fibrous and non-hazardous to the user.

(3) The materials are, at least at present, relatively inexpensive.

(4) Batch mixing is possible and the dry feed flowability good.

(5) The present composition is compatible with existing blending and handling systems.

B. Slurry Characteristics (1) The slurried composition has good fluidity and will pick up the detail of the master.

(2) Upon mixing in the Hogue machine for short periods of time, a creamy state is established, eliminating settling of the dense ingredients.

(3) A low temperature (less than 120° F.) operation is possible.

(4) The slurried mold composition has a fast setting time (5–20 minutes).

(5) The water-to-solids ratio (the amount of water added per unit weight solids) is acceptable.

(6) The release characteristics from the master pattern are good.

C. Wet Mold Features (1) The newly cast mold of the composition of the present invention has good green strength.

(2) The setting expansion is low.

(3) The wet mold is easily cut (shaved) in trimming.

(4) Likewise, it is easily patched or repaired.

(5) Finally, it is able to take a reverse cast.

D. Dry Mold Features (1) Acceptable permeability of the dry mold can be achieved.

(2) Burnout shrinkage (that occurring on drying the plaster mold) is low, typically less than 0.15%.

(3) Low drying temperatures (less than 400° F.) are required.

(4) There is no migration of salts to the surface on drying.

(5) The mold surface is generally free of blisters and cracks.

(6) A low thermal shock sensitivity is found, i.e., it is not necessary to cool slowly on removal from the drying oven.

(7) The dry mold has a relatively low bulk density which is good in terms of ease of gating, inserting chills, etc.

(8) Likewise, the mold is soft enough to insert the chill wires easily and, therefore, it is possible to use chills to cool the mold rapidly and thoroughly during metal casting.

(9) The mold also has a low enough dry strength to permit easy crushing for disposal or recycling.

(10) There is no metal discoloration from the mold.

(11) The mold is easily separated from the casting.

With all of these features obtainable using the molding composition of the present invention, it can be seen that a suitable replacement for fiber-containing molding compositions is provided.

Accordingly, it is an object of the present invention to provide such a suitable fiber-free molding composition.

Other objects and advantages of the present invention will be apparent from the following description and the appended claims.

DESCRIPTION OF THE PREFERRED EMBODIMENTS

As mentioned, the preferred composition of the present invention comprises approximately 50–70% gypsum plaster, 5–25% fine expanded perlite, and 5–30% filler. More preferably, it consists by weight of 60% gypsum plaster, 10 to 15% fine expanded perlite, 25 to 30% of a non-fibrous filler such as a mixture of mica and fly ash and a small amount of Terra Alba. The preferred gypsum plaster is such as that marketed by U.S. Gypsum under the designation No. 1 Molding Plaster. The more plaster used, the more rapid setting time, the stronger the mold, etc. While rapid setting times are generally desired, too much dry mold strength is to be avoided. The 50–70% amount is preferred although possibly larger amounts could be used.

On the other hand, it can generally be said that the more expanded perlite used, the less dense and softer the dry mold will be. The less perlite, the harder and stronger the mold will be. Accordingly, since it is desirable to produce a mold which is not only strong enough to handle and receive the metal castings, but also soft enough to shave, insert chill wires, etc., 10 to 15% of expanded perlite is most preferred.

Likewise, it is desirable that the expanded perlite particles be as fine as possible. This is because larger expanded perlite particles could cause undesirable grainy textures on the cast metal surface. Perlite is an expandable silicous volcanic rock, i.e., when heated above 1600° F., crushed perlite rock expands in a manner similar to popcorn. This creates microballoons within the material. In its coarser state, expanded perlite is used as a lightweight aggregate in wall plasters and wallboard. See for example, U.S. Pat. Nos. 2,871,134; 2,980,548; 3,183,107; 3,226,243; and 3,311,516. The larger particles of the expanded perlite contain relatively large microballoons. On the surface of the mold, then, microballoons which are too large cause voids beneath the mold surface which if ruptured, produce the undesirable grainy cast metal surface. Therefore, the expanded perlite used in the present invention should be sufficiently small so that at least 50% passes a −50 mesh screen. Most preferred is the finest grade available such as No. 4 Ryolex perlite from Silbrico Corp. That material is so fine that over 85% passes a −325 mesh screen.

Other acceptable materials include Grades 3S and 39 Ryolex perlite. These grades have the particle size gradation given in Table I, following:

TABLE I

| Weight Percent of Material Retained in Indicated Sieve | | Ryolex Expanded Perlite | |
|---|---|---|---|
| | No. 4 | No. 39 | No. 3S |
| +16 | — | — | Trace |
| −16+20 | — | — | 2 |
| −20+30 | — | 2 | 12 |
| −30+50 | — | 35 | 36 |
| −50+100 | — | 45 | 30 |
| −100+200 | — | 10 | 20 |
| −200±325 | — | 8 | — |
| −325 85 | (minimum passing) | — | — |
| Packaged Density, lb/ft$^3$ | 10 | 7 | 3 |

Since the fine expanded perlite serves, among other things, as a thickening agent for the slurried composition, the amount of water required for slurrying depends in large part on the amount of expanded perlite used. That is, in the fibrous talc-containing compositions of the past, a water/solids (w/s) ratio of around 1.0–1.3 was preferred for a slurry having all the desired characteristics. The optimum water/solids ratio useful in preparing slurries of the present compositions varies according to the amount of expanded perlite used. In Table II, below, these optimum w/s figures are given. The following discussion of mold composition trials and tables deals, then, with ones mixed at the optimum water/solids ratio based on Table II. The acceptable w/s ratios for slurrying can be said to range around the optimum ±0.2.

TABLE II

| Expanded Perlite Content (Weight %) | Optimum W/S Weight Ratio |
|---|---|
| 5.0 | 0.80 |
| 7.5 | 0.95 |
| 10.0 | 1.05 |
| 12.5 | 1.15 |
| 15.0 | 1.30 |
| 17.5 | 1.40 |
| 20.0 | 1.55 |
| 25.0 | 1.80 |

As mentioned, the filler may be selected from the group consisting of mica, silica, fly ash, pyrophyllite, and mixtures thereof. Other possibilities include alumina, calcined clays, bauxite and olivine. While the preferred amount used will vary depending on the particular filler chosen, it will range generally from 5–30% by weight. The most preferred filler is a combination of materials containing fine mica (160 mesh). Such a material can be obtained from Harris Mining Co., Spruce Pine, N.C. Best results have been achieved when the mica content is between 5 and 20% and other non-fibrous fillers are added thereto to give a preferred total filler amount of 25–30%.

Finally, it should be noted that a Terra Alba accelerator can be used in small amounts (approximately 1% by weight of plaster—more or less can be used depending on the circumstances). Terra Alba is a hydrous calcium silicate. It is a known accelerator for gypsum plaster, see U.S. Pat. No. 2,940,403. Other known accelerators may be used in place of Terra Alba.

In general terms, test runs have shown the fiber-free molding composition of the present invention to have satisfactory properties in the area of:

(1) drying behavior,
(2) rheology of the slurry,
(3) strength in both the wet and dry state,
(4) dimensional stability,
(5) reverse casting,
(6) forming characteristics and,
(7) metal casting quality.

Also in general terms, the fiber-free molding composition of the instant invention has been found to have the following properties:

| Measured Property | Typical Values for Fiber-Free Molding Composition |
|---|---|
| Bulk Density, pcf | |
| Wet | 82–95 |
| Dry | 33–45 |
| Modulus of | |

-continued

| Measured Property | Typical Values for Fiber-Free Molding Composition |
|---|---|
| Rupture, psi | |
| Wet | 50–130 |
| Dry | 30–100 |
| Burnout Shrinkage, Percent of Original Length | 0.04 to 0.18 |

More specific results in terms of properties and performance are given in the example which follows.

EXAMPLE

In this example, two compositions having constituents within the preferred range were tested. The make-up of Compositions 1 and 2 is given is Table III:

TABLE III

| Constituent | Percent of Dry Batch Weight | |
|---|---|---|
| | Composition 1 | Composition 2 |
| U.S. Gypsum No. 1 Molding Plaster | 60 | 60 |
| Silbrico Co. No. 4 Ryolex Perlite | 15 | 10 |
| Flyash, Amex Corp. | 15 | 10 |
| Harris Mining Corp. No. 160 Mica | 10 | 20 |

Note: Terra Alba added at a rate of 1 percent of gypsum plaster weight.

These slurried compositions, with 105° F. water at the optimum w/s water amounts (except for Composition 1 which had a slightly modified w/s ratio of 1.2–1.0), were subjected to several tests in both the wet and dry mold states. The mold was dried in a 400° F. oven until the mold itself reached 300° F. The results are set forth in Table IV, as follows:

TABLE IV

| Composition | Bulk Density, pcf | | Modulus of Rupture, psi | | Burnout Shrinkage, Percent |
|---|---|---|---|---|---|
| | Wet | Dry | Wet | Dry | |
| 1 | 85 | 41 | 77 | 54 | 0.11 |
| 2 | 85 | 42 | 66 | 51 | 0.08 |

For comparison purposes, reference is made to Example I of the parent application, Ser. No. 660,444, filed Feb. 23, 1976. There compositions A, B, and C were tested by similar procedures. Composition A contained fibrous talc such as that used in the past, Compositions B and C contained 15% Wollastonite and 10 and 15% perlite, respectively. The results of tests on those compositions, as set forth in Table III of the cross-referenced application, are partially reproduced in the following Table V.

TABLE V

| Run | Bulk Density, pcf | | MOR psi | | Burnout Shrinkage % |
|---|---|---|---|---|---|
| | Wet | Dry | Wet | Dry | |
| A. | 90 | 45 | 94 | 74 | 0.08 |
| B. | 90 | 43 | 95 | 73 | 0.04 |
| C. | 83 | 36 | 62 | 38 | 0.06 |

While the Wollastonite-perlite containing Compositions B and C of the parent application equaled or exceeded the fibrous talc-containing Composition A, so does the fiber-free Compositions 1 and 2 of the present invention. That is, the lower the bulk density (as long as the strength is maintained), the better. Compositions 1 and 2 have a lower bulk density than A and B, and are almost as low as C.

And yet, the flexural strength in terms of modulus of rupture (MOR) was better than that of C and in the desired 50–100 psi range for green strength. Likewise, compositions 1 and 2 exhibit an adequate burnout shrinkage when compared to A, B, and C (the lower percentage, the better).

As can be seen from these examples the present invention provides a suitable fiber-free metal castings molding composition having dry blend, slurry, wet and dry mold properties equal to or better than prior fibrous talc containing compositions. Accordingly, the need in the industry for a replacement for molding compositions containing fibrous constituents has been met with this invention.

While the composition herein described constitutes a preferred embodiment of the invention, it is to be understood that the invention is not limited to this precise composition, and that changes may be made therein without departing from the scope of the invention.

What is claimed is:

1. In a metal castings molding composition having as its principal component gypsum plaster present in the range of 50–70% by weight of said composition, the improvement comprising the addition of 5–25% by weight fine expanded perlite at least 50% of which will pass through a −50 mesh screen, and the remainder consisting essentially of at least 5% by weight non-fibrous filler selected from the group consisting of mica, silica, fly ash, pyrophyllite, and mixtures thereof, whereby there is produced a fiber-free metal castings molding composition having good dry blend properties, slurry characteristics, and wet and dry mold features.

2. A fiber-free molding composition as set forth in claim 1 wherein said expanded perlite is present in the amount of approximately 10% to 15% by weight.

3. A fiber-free molding composition as set forth in claim 2 wherein said filler is present in the amount of approximately 25–30%.

4. A fiber-free molding composition as set forth in claim 3 wherein said filler is a mixture of fine mica and other non-fibrous materials, said fine mica being present in the amount of approximately 5–20% of the total composition.

5. A fiber-free molding composition as set forth in claim 4 wherein said fine expanded perlite is a mineral at least 85% of which will pass a −325 mesh screen.

6. A fiber-free molding composition as set forth in claim 3 further including a Terra Alba accelerator at approximately 1% by weight of said plaster.

* * * * *